US009997832B2

(12) United States Patent
Hsu et al.

(10) Patent No.: US 9,997,832 B2
(45) Date of Patent: Jun. 12, 2018

(54) COLLINEAR DIPOLE ANTENNA AND COMMUNICATION DEVICE THEREOF

(71) Applicant: Wistron NeWeb Corporation, Hsinchu (TW)

(72) Inventors: Chieh-Sheng Hsu, Hsinchu (TW); Cheng-Geng Jan, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 261 days.

(21) Appl. No.: 14/937,893

(22) Filed: Nov. 11, 2015

(65) Prior Publication Data

US 2016/0352019 A1 Dec. 1, 2016

(30) Foreign Application Priority Data

May 26, 2015 (TW) ..... 104116761 A

(51) Int. Cl.
*H01Q 5/321* (2015.01)
*H01Q 9/28* (2006.01)

(52) U.S. Cl.
CPC ..... *H01Q 5/321* (2015.01); *H01Q 9/285* (2013.01)

(58) Field of Classification Search
CPC ..... H01Q 5/321
USPC ..... 343/801
See application file for complete search history.

(56) References Cited

U.S. PATENT DOCUMENTS 6,809,687 B2 * 10/2004 Yuanzhu ..... H01Q 1/38 343/700 MS
7,180,466 B2 * 2/2007 Kuroda ..... H01Q 1/38 343/700 MS
8,552,918 B2 * 10/2013 Lee ..... H01Q 9/285 343/702
2003/0156064 A1 8/2003 Bancroft

OTHER PUBLICATIONS

Y.T. Liu, T.C. Tseng and K.L. Wong, "High-gain printed dipole antenna," Microwave and Opt. Technol. Lett., vol. 46, No. 3, pp. 214-218, Aug. 5, 2005.

* cited by examiner

*Primary Examiner* — Dameon E Levi
*Assistant Examiner* — Walter Davis
(74) *Attorney, Agent, or Firm* — Winston Hsu

(57) ABSTRACT

A collinear dipole antenna includes first and second radiators. The first radiator includes a first arm and at least one second arm including first and second branches, and the second radiator includes a third arm and at least one fourth arm including third and fourth branches. The first and third branches have negative current phases and meandering shapes, and the first and third arms and the second and fourth branches have positive current phases. Widths of the first and third arms gradually increase to a maximum width and gradually decrease after the maximum width is reached. Widths of the second and fourth branches gradually increase to the maximum width and gradually decrease after the maximum width is reached.

20 Claims, 16 Drawing Sheets m1: (-100°,-100°,3.51)
m2: ( 0°, 0°,3.45)
m3: (-100°,-100°,3.81)
m4: (-10°,-10°,3.75)
m5: ( 180°,180°,2.91)
m6: ( 85°,85°,2.75)

m1: (-105°,-105°,5.07)
m2: (-10°,-10°,5.01)
m3: (-100°,-100°,6.31)
m4: (-10°,-10°,6.25)
m5: ( 180°,180°,3.41)
m6: ( 85°,85°,3.25)

m1: (105°,105°,3.49)
m2: (-20°,-20°,3.42)
m3: (-100°,-100°,4.09)
m4: (-15°,-15°,4.03)
m5: ( -175°,-175°,2.70)
m6: ( 85°,85°,2.52)

COLLINEAR DIPOLE ANTENNA AND COMMUNICATION DEVICE THEREOF

BACKGROUND OF THE INVENTION

1. Field of the Invention

The present invention relates to a collinear dipole antenna and communication device, and more particularly, to a collinear dipole antenna and communication device whose arms with positive current phase having a bishop-hat shape and arms with negative current phase having a meandering shape.

2. Description of the Prior Art

New generation Wi-Fi communication system utilizes beam forming technique to form either an omni-directional pattern or a directional pattern, wherein the omni-directional and directional patterns can be synthesized by combining multiple collinear antennas, wherein the collinear antennas are omni-directional with high gain. There are various types for collinear antennas, one of which is formed by dipole antennas.

Operations of the collinear dipole antenna are described in the following description. FIG. 1 is a schematic diagram of a collinear dipole antenna 10. The collinear dipole antenna 10 includes radiators 11 and 12, a feed terminal 103, and a substrate 104. The radiators 11 and 12 may be formed on the substrate 104. The radiator 11 is electrically connected to the feed terminal 103 to receive a radio signal (generated by a radio signal processing unit not shown in FIG. 1) via the feed terminal 103. The radiator 12 is electrically connected to a ground.

FIG. 1 further illustrates wavelengths and current phases corresponding to an operating frequency of the radiators 11 and 12. In general, in order to increase an antenna gain on horizontal sections, a total length of the radiators 11 and 12 may be N wavelengths plus a quarter-wavelength of the operating frequency, where N is an integer. A same boundary condition at open ends of the radiators 11 and 12 is reserved since intensities of the currents flowing on the radiators 11 and 12 repeat at every wavelength and the intensities of currents are zero at the quarter-wavelength. Therefore, the radiators 11 and 12 can satisfy a same resonance requirement due to the same boundary condition, i.e., currents on the radiators 11 and 12 are always zero at the open ends.

The antenna gain on the horizontal section is positively correlated with current components with positive phases, while the antenna gain on the horizontal section is negatively correlated with current components with negative phases. As can be seen from a current phase distribution of the collinear dipole antenna 10, the antenna gain is decreased due to the current components with negative phases. In addition, there are issues for the collinear dipole antenna 10 needed to be solved such as insufficient bandwidth and dramatically gain drop within the bandwidth.

Therefore, how to improve the antenna performance of the collinear dipole antenna, such as increasing the antenna gain, broadening the bandwidth and smoothing the gain drop within the bandwidth, has become a topic in the industry.

SUMMARY OF THE INVENTION

An objective of the present invention is to provide a collinear dipole antenna and communication device whose arms with positive current phase having a bishop-hat shape and arms with negative current phase having a meandering shape so as to improve antenna performance.

An embodiment of the present invention discloses a collinear dipole antenna. The collinear dipole antenna includes a substrate, a feed terminal, a first radiator and a second radiator. The first radiator is formed on the substrate and electrically connected to the feed terminal, wherein the first radiator includes a first arm with a positive current phase and at least one second arm. The first arm is electrically connected to the feed terminal and extends from the feed terminal along a first direction. The at least one second arm is electrically connected to the first arm and extends from the first arm along the first direction, wherein the at least one second arm includes a first branch with a negative current phase and electrically connected to the first arm, and a second branch with the positive current phase and electrically connected to the first branch. The second radiator is formed on the substrate and electrically connected to a ground, wherein the second radiator includes a third arm with the positive current phase and at least one fourth arm. The third arm is electrically connected to the ground and extends from the ground along an opposite of the first direction. The at least one fourth arm is electrically connected to the third arm and extends from the third arm along the opposite of the first direction, wherein the at least one fourth arm includes a third branch with the negative current phase and electrically connected to the third arm, and a fourth branch with the positive current phase and electrically connected to the third branch. The first and third branches have a meandering shape, widths of the first arm and the third arm gradually increase from where the first arm and the third arm are connected to the feed terminal and the ground until a maximum width is reached, and the widths of the first arm and the third arm gradually decrease after the maximum width is reached. Widths of the second and fourth branches gradually increase from where the second and fourth branches are connected to the first branch and the third branch until the maximum width is reached, and the widths of the second and fourth branches gradually decrease after the maximum width is reached.

Another embodiment of the present invention discloses a communication device including a radio signal processing unit for processing a radio signal, and a collinear dipole antenna. The collinear dipole antenna includes a substrate, a feed terminal, a first radiator and a second radiator. The first radiator is formed on the substrate and electrically connected to the feed terminal, wherein the first radiator includes a first arm with a positive current phase and at least one second arm. The first arm is electrically connected to the feed terminal and extends from the feed terminal along a first direction. The at least one second arm is electrically connected to the first arm and extends from the first arm along the first direction, wherein the at least one second arm includes a first branch with a negative current phase and electrically connected to the first arm, and a second branch with the positive current phase and electrically connected to the first branch. The second radiator is formed on the substrate and electrically connected to a ground, wherein the second radiator includes a third arm with the positive current phase and at least one fourth arm. The third arm is electrically connected to the ground and extends from the ground along an opposite of the first direction. The at least one fourth arm is electrically connected to the third arm and extends from the third arm along the opposite of the first direction, wherein the at least one fourth arm includes a third branch with the negative current phase and electrically connected to the third arm, and a fourth branch with the positive current phase and electrically connected to the third branch. The first and third branches have a meandering shape, widths of the first arm and the third arm gradually increase from where the first arm and the third arm are connected to the feed terminal and the ground until a maximum width is reached, and the widths of the first arm and the third arm gradually decrease after the maximum width is reached. Widths of the second and fourth branches gradually increase from where the second and fourth branches are connected to the first branch and the third branch until the maximum width is reached, and the widths of the second and fourth branches gradually decrease after the maximum width is reached.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
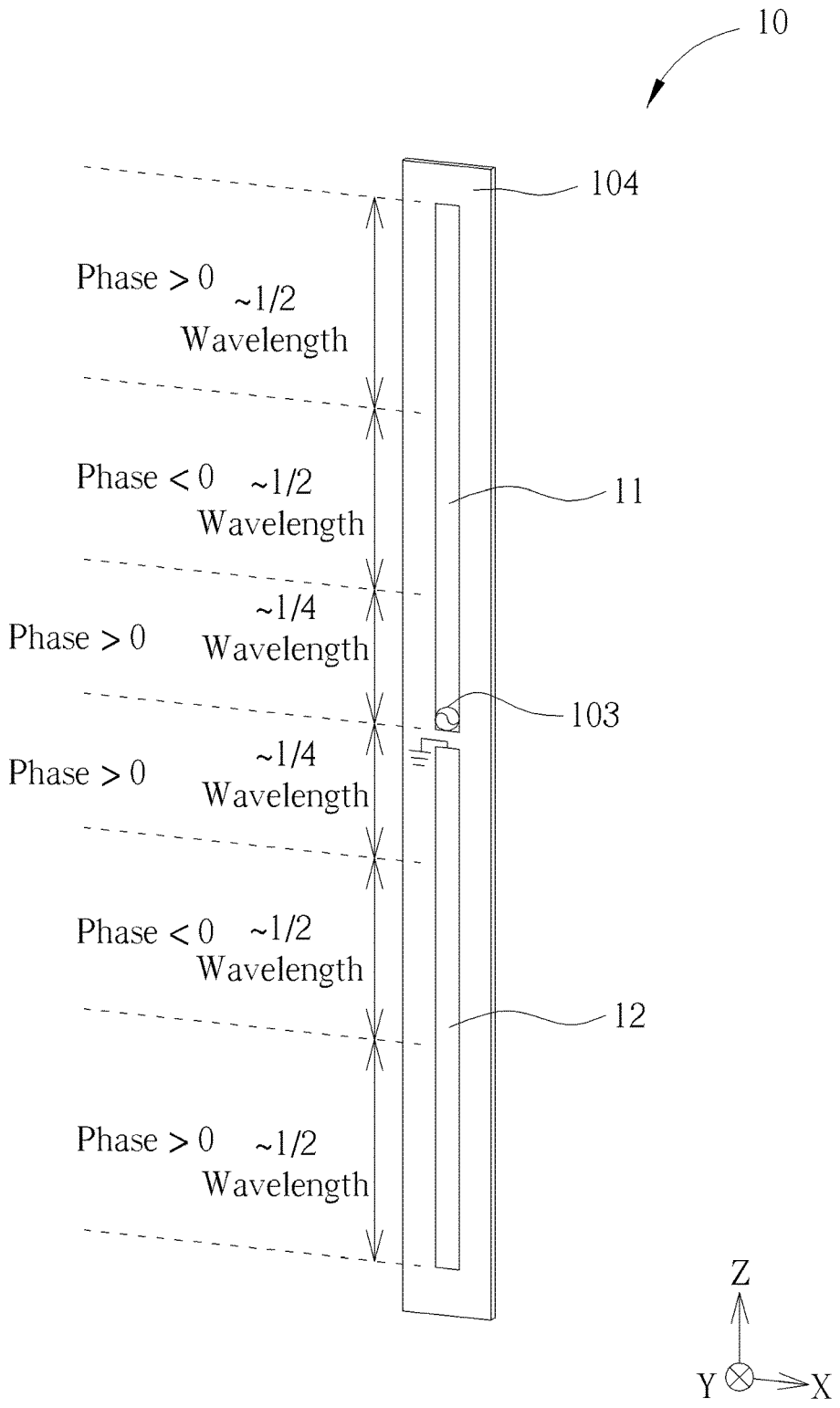
FIG. 1 PRIOR ART
FIG. 1 is a schematic diagram of a collinear dipole antenna.
Figure 2:
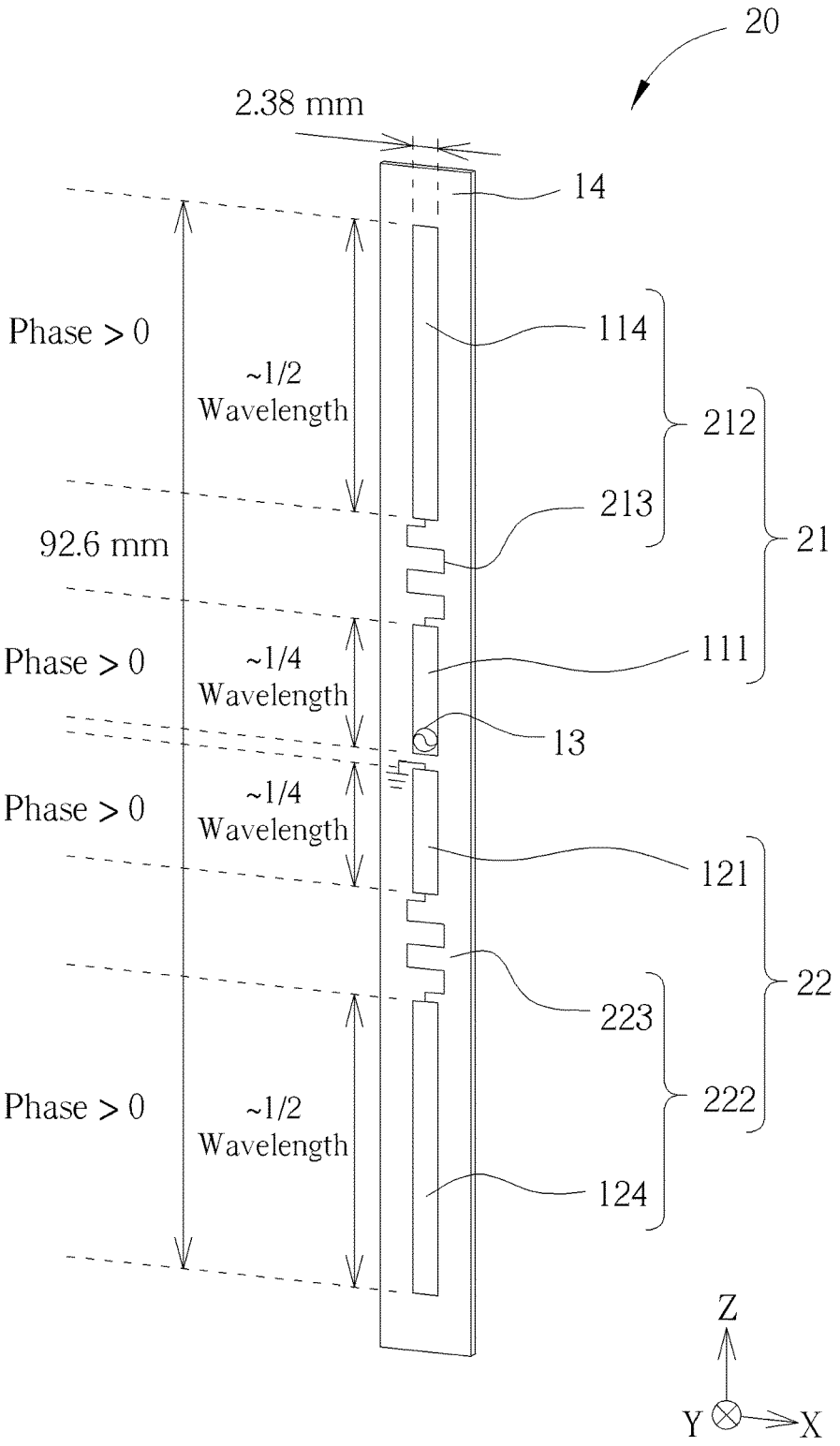
FIG. 2 is a schematic diagram of another collinear dipole antenna according to an embodiment of the present invention.

FIG. 2 is a schematic diagram of a collinear dipole antenna 20 according to an embodiment of the present invention. The collinear dipole antenna 20 includes radiators 21 and 22, a feed terminal 13, and a substrate 14. The radiators 21 and 22 are formed on the substrate 14. The radiator 21 includes arms 111 and 212 cascaded to each other. The radiator 22 includes arms 121 and 222 cascaded to each other. The arm 212 includes branches 213 and 114 cascaded to each other. The arm 222 includes branches 223 and 124 cascaded to each other. In one embodiment, for 5 GHz frequency band, a width and a length of the collinear dipole antenna 20 may be 2.38 millimeters and 92.6 millimeters, respectively.

A difference between the collinear dipole antennas 10 and 20 lies in that branches of the radiators 11 and 12 with negative current phase (hereinafter called NCP) are replaced by branches having a meandering shape, i.e., the branch 213 of the radiator 21 and the branch 223 of the radiator 22 have the meandering shape. In such a structure, current intensities of the branches 213 and 223 with the NCP along the Z direction may be effectively reduced, which decreases a reduction to current intensities of the arms 111 and 121 and the branches 114 and 124 with the positive current phase (hereinafter called PCP) along the Z direction. Therefore, a gain of the collinear dipole antenna 20 may be increased by reducing the current intensities of the branches with the NCP.

Figure 3:
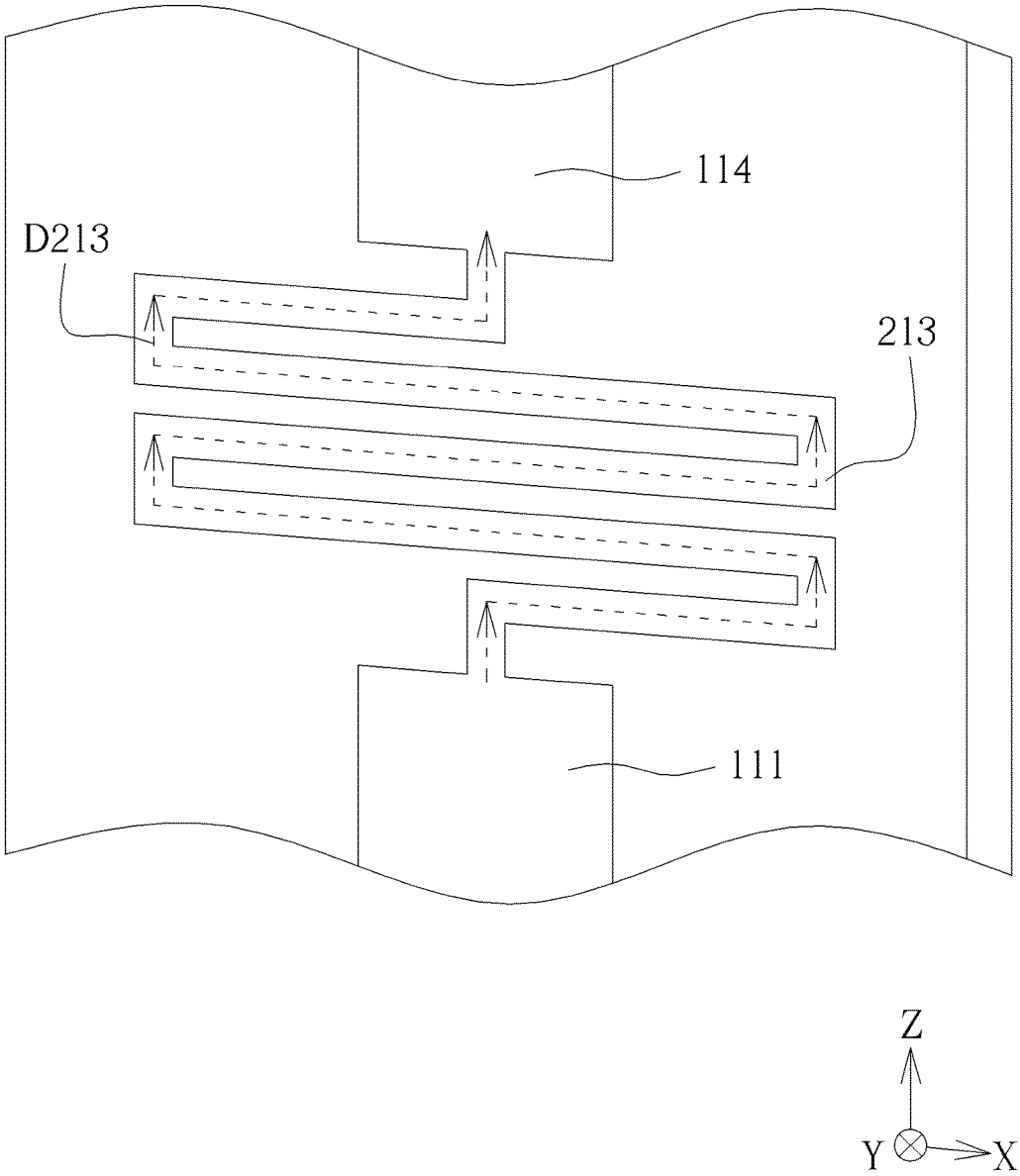
FIG. 3 shows an enlargement of a part of the collinear dipole antenna shown in FIG. 2.

Furthermore, FIG. 3 shows an enlargement of a part of the radiator 21. A current path D213 on the arm 213 having the meandering shape includes current components along the Z direction, +X direction and −X direction, respectively. Most of the current components of the current path D213 are guided to the +X direction and −X direction (current routes longer along the +X and −X directions). The current components along the +X direction and −X direction have a same current intensity but different directions, so they are cancelled by each other. Only a small amount of the current components of the current path D213 is guided to the Z direction (current routes shorter along the Z direction). Therefore, the current intensity of the arm 213 with the NCP along the Z direction is quite small to be neglected. Similarly, the current intensity of the arm 223 with the NCP along the Z direction is quite small to be neglected due to its meandering shape. A length of the current path D213 may be a half-wavelength of the operating frequency of the collinear dipole antennas 10 and 20, so that the resonance requirement of the collinear dipole antennas 10 and 20 may be the same.

Since the current intensities of the arms 213 and 223 along the Z direction are neglected, the reduction to the current intensities of the arms 111 and 121 and the branches 114 and 124 along the Z direction can be equivalently decreased. Thus, the antenna gain on the horizontal section of the collinear dipole antenna 20 is increased. In other words, since the arms 213 and 223 are neglected, the two-section collinear dipole antenna 20 having the radiators 21 and 22 with the pure PCP may be formed, wherein the term "two-section" refers to a combination of the arms 111 and 212 or a combination of the arms 121 and 222.

Figure 4:
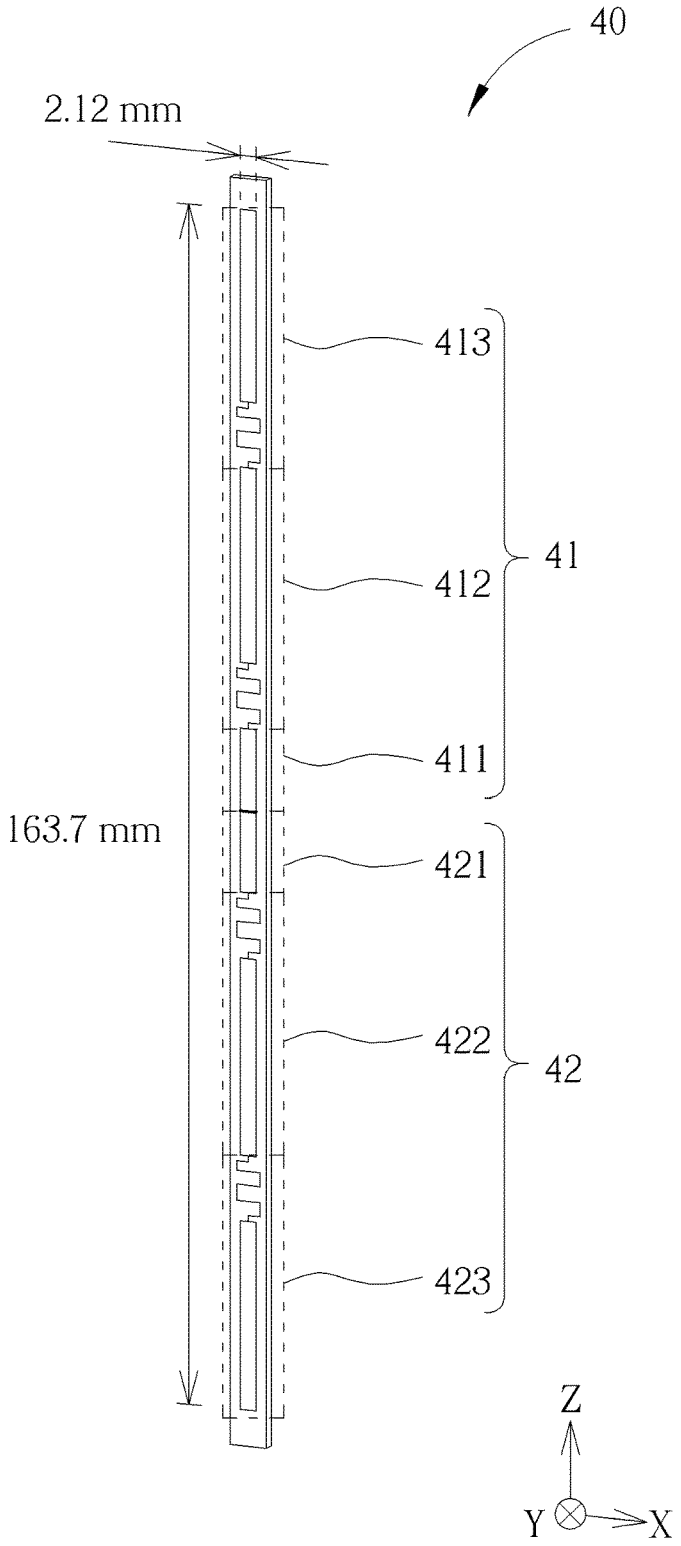
FIG. 4 is a schematic diagram of another collinear dipole antenna according to an embodiment of the present invention.

FIG. 4 is a schematic diagram of another collinear dipole antenna 40 according to an embodiment of the present invention. The collinear dipole antenna 40 is formed by extending the arm of the collinear dipole antenna 20 by one wavelength to form a three-section collinear dipole antenna. The collinear dipole antenna 40 includes radiators 41 and 42. The radiator 41 includes arms 411, 412 and 413. The radiator 42 includes arms 421, 422 and 423. In one embodiment, for the 5 GHz frequency band, a width and a length of the collinear dipole antenna 40 may be 2.12 millimeters and 163.7 millimeters, respectively.

Figure 5:
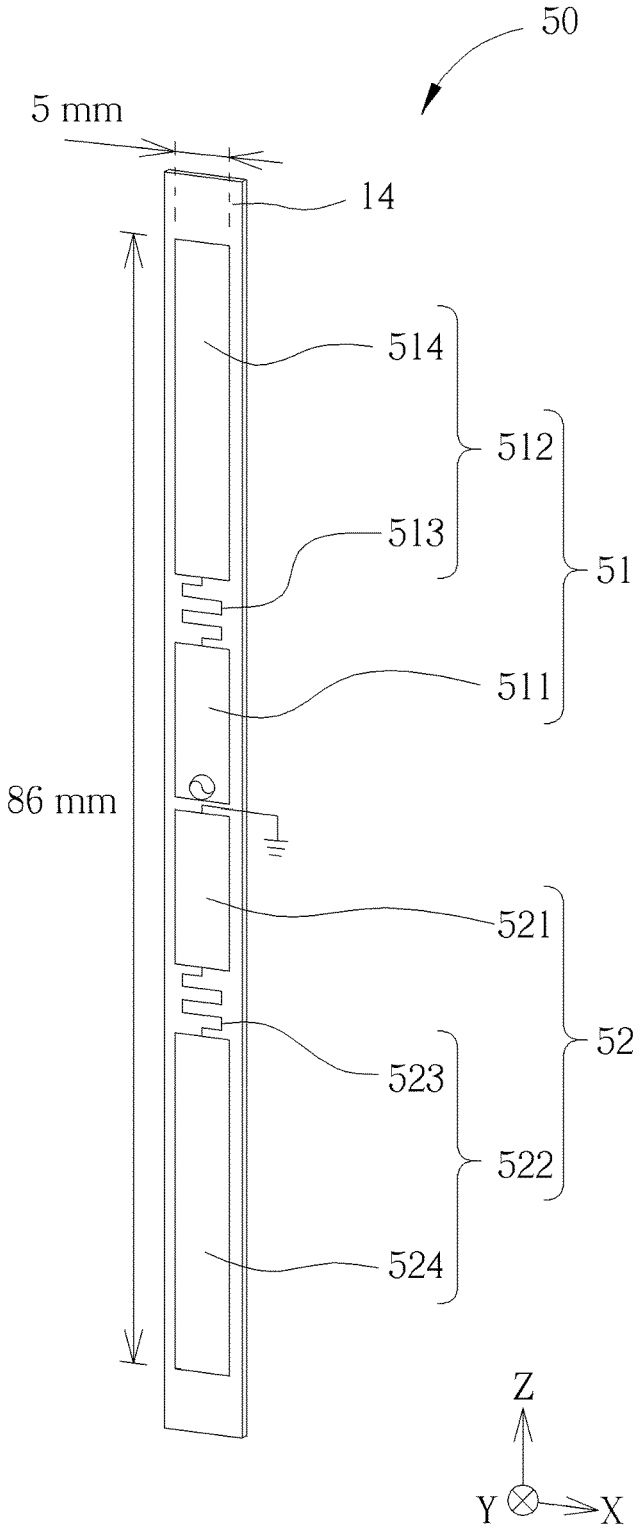
FIG. 5 is a schematic diagram of another collinear dipole antenna according to an embodiment of the present invention.

FIG. 5 is a schematic diagram of a two-section collinear dipole antenna 50 according to an embodiment of the present invention. The collinear dipole antenna 50 includes radiators 51 and 52. The radiator 51 includes arms 511 and 512, wherein the arm 512 includes branches 513 and 514. The radiator 52 includes arms 521 and 522, wherein the arm 522 includes branches 523 and 524. A width of the collinear dipole antenna 50 is wider than the width of the collinear dipole antenna 20. With the wider width, the return loss may be improved. In one embodiment, for the 5 GHz frequency band, the width and a length of the collinear dipole antenna 50 may be 5 millimeters and 86 millimeters, respectively.

Figure 6:
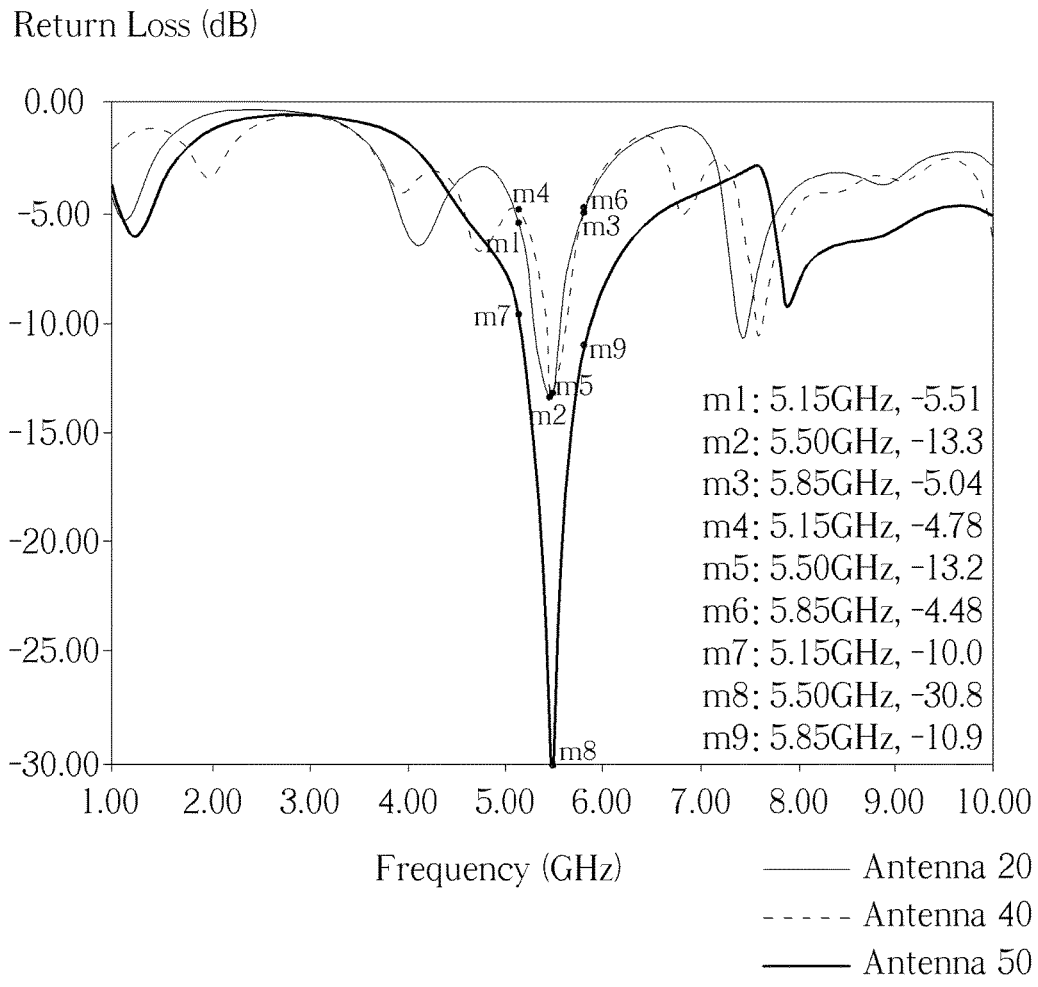
FIG. 6 shows simulations of return losses of the collinear dipole antennas shown in FIG. 2, FIG. 4 and FIG. 5.
Figure 7:
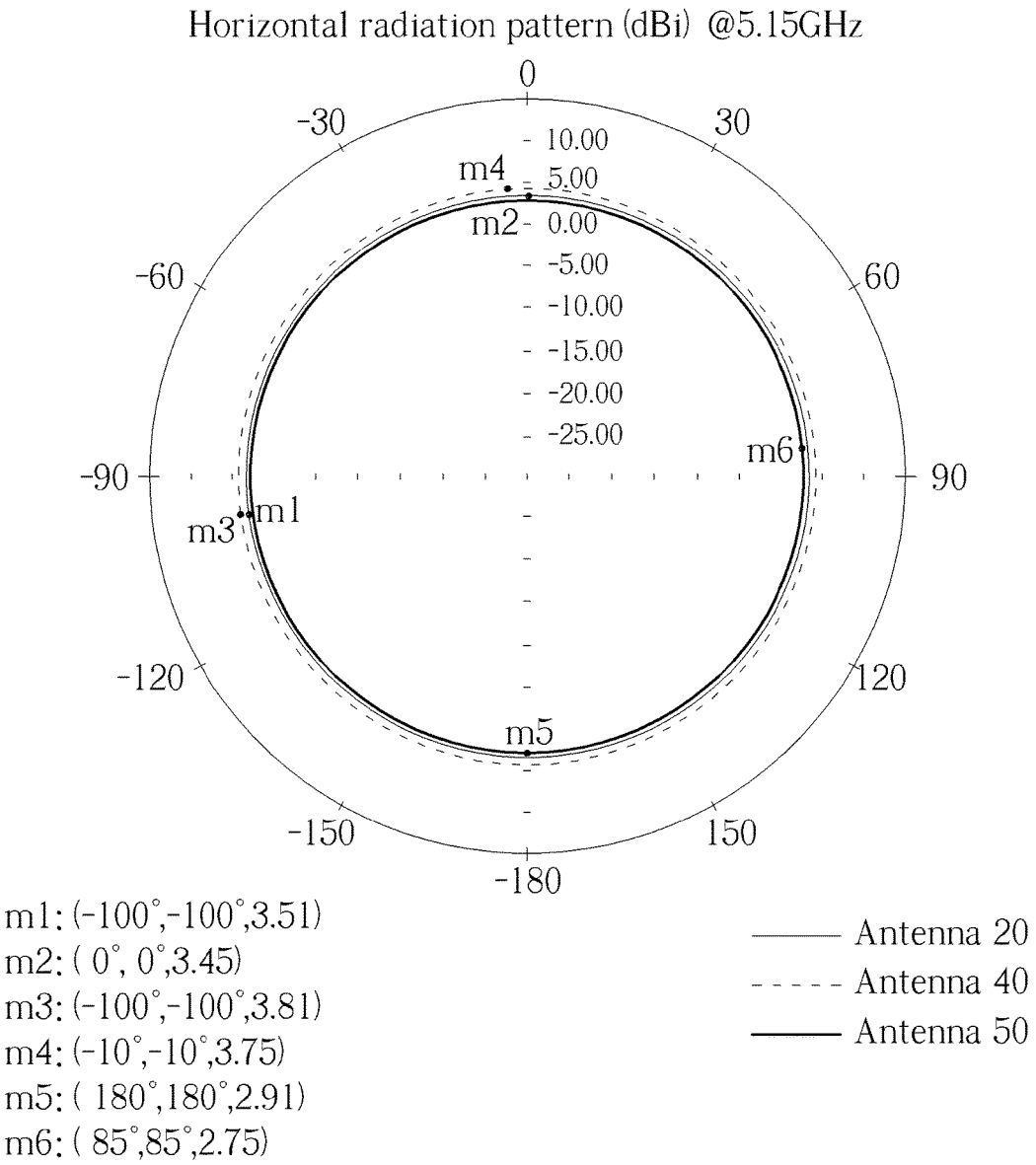
FIG. 7 shows simulations of radiation patterns of the collinear dipole antennas shown in FIG. 2, FIG. 4 and FIG. 5 at 5.15 GHz on a horizontal section.
Figure 8:
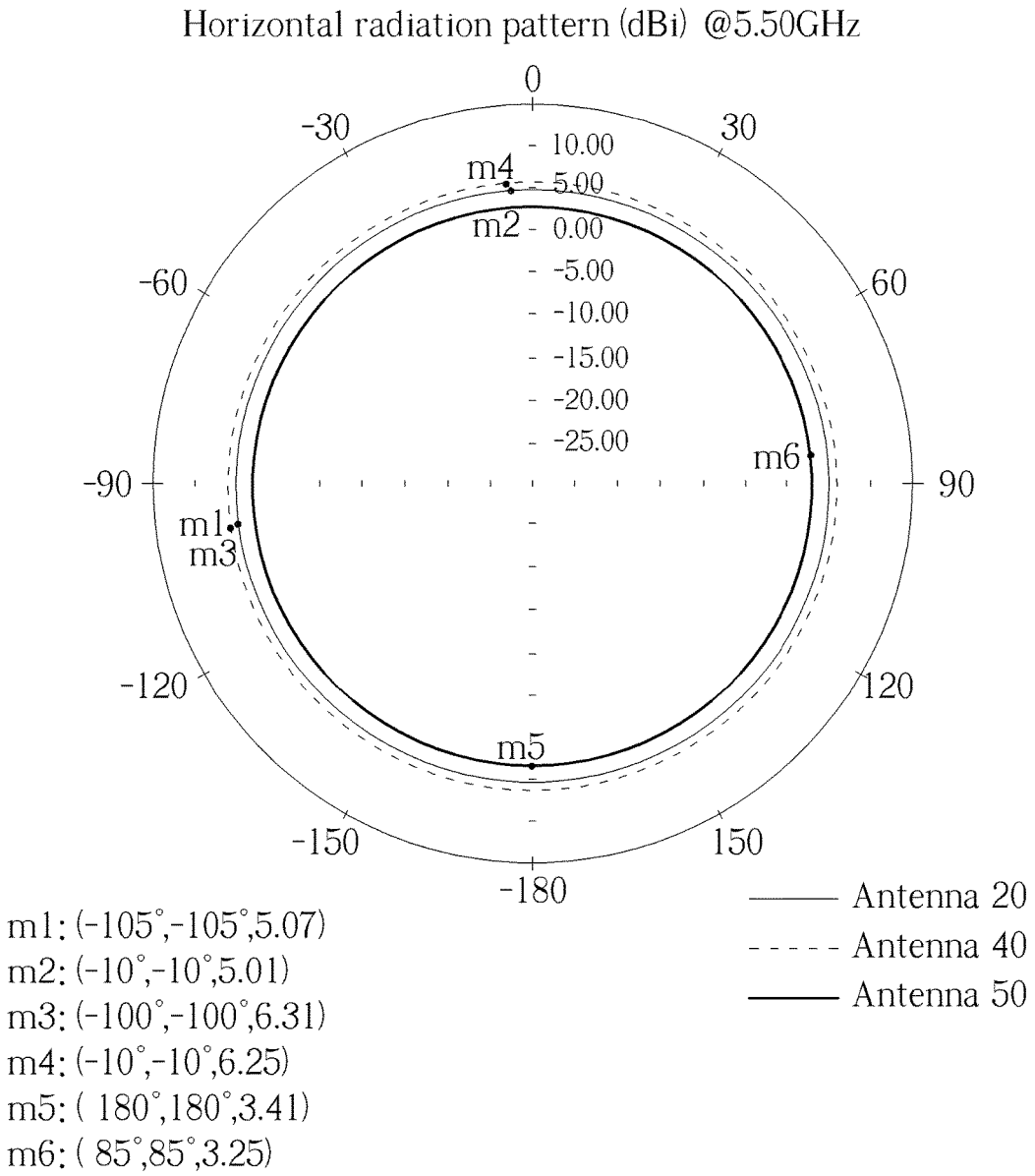
FIG. 8 shows simulations of radiation patterns of the collinear dipole antennas shown in FIG. 2, FIG. 4 and FIG. 5 at 5.50 GHz on a horizontal section.
Figure 9:
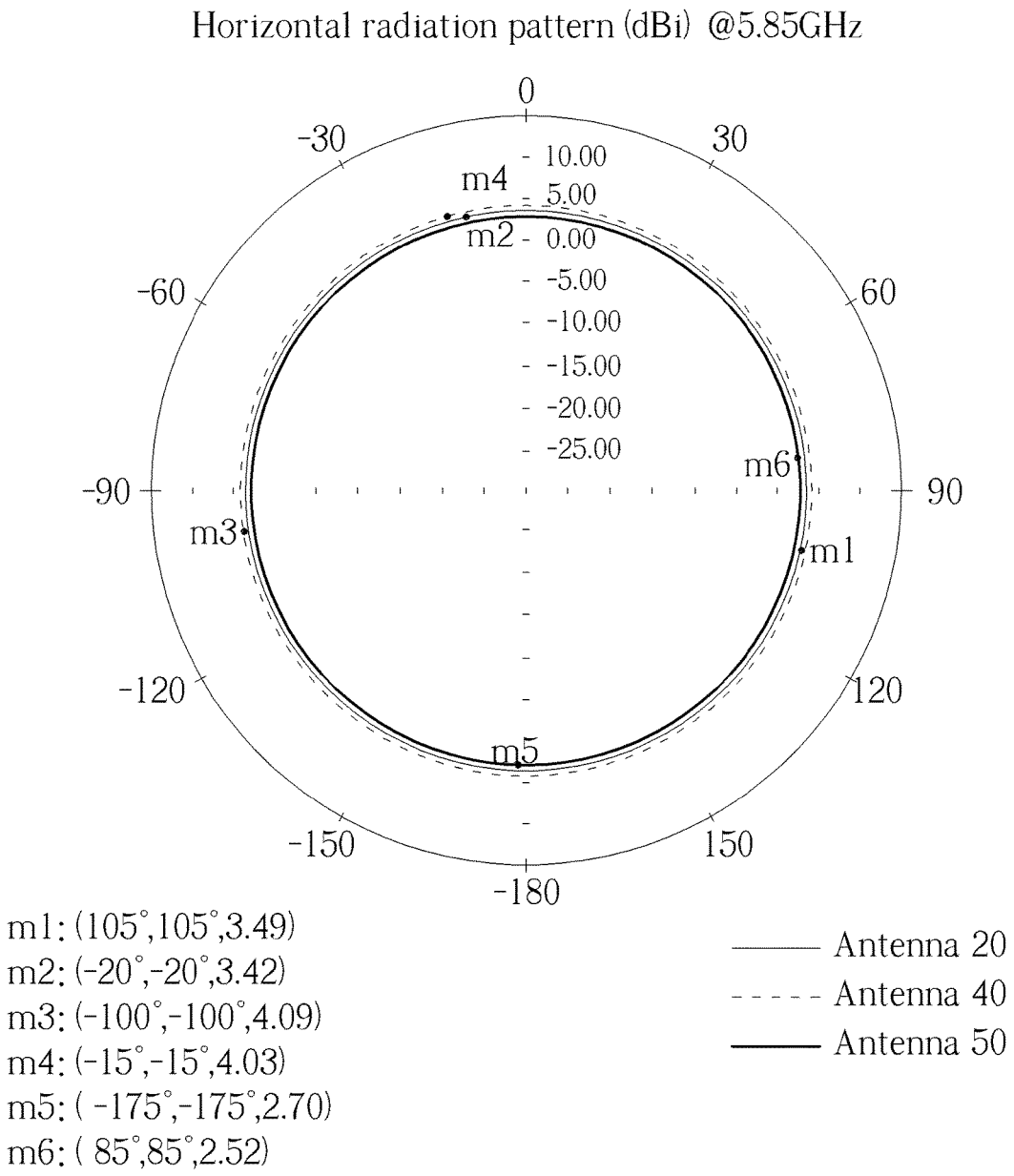
FIG. 9 shows simulations of radiation patterns of the collinear dipole antennas shown in FIG. 2, FIG. 4 and FIG. 5 at 5.85 GHz on a horizontal section.

FIG. 6 shows simulations of return losses of the collinear dipole antennas 20, 40 and 50, wherein the return losses of the collinear dipole antennas 20, 40 and 50 are respectively denoted with a thin solid line, a dotted line, and a thick solid line. FIG. 7 shows simulations of radiation patterns of the collinear dipole antennas 20, 40 and 50 shown in FIG. 2, FIG. 4 and FIG. 5 at 5.15 GHz on a horizontal section (X-Y plane). FIG. 8 shows simulations of radiation patterns of the collinear dipole antennas 20, 40 and 50 at 5.50 GHz on the horizontal section. FIG. 9 shows simulations of radiation patterns of the collinear dipole antennas 20, 40 and 50 at 5.85 GHz on the horizontal section. The radiation patterns of the collinear dipole antennas 20, 40 and 50 are respectively denoted with a thin solid line, a dotted line, and a thick solid line. Antenna gains on the horizontal section of the collinear dipole antennas 20, 40 and 50 are summarized in Table 1.

TABLE 1

(Unit: dBi)

| Frequency (GHz) | Antenna 20 | Antenna 40 | Antenna 50 |
|---|---|---|---|
| 5.15 | 3.45-3.51 | 3.75-3.81 | 2.75-2.91 |
| 5.50 | 5.01-5.07 | 6.25-6.31 | 3.25-3.41 |
| 5.85 | 3.42-3.49 | 4.03-4.09 | 2.52-2.70 |

According to FIG. 6 to FIG. 9, among the collinear dipole antennas 20, 40 and 50, the collinear dipole antenna 50 has the best return loss (maximum to be −10 dB), but it has the worst antenna gain. Accordingly, though increasing the width of the radiator may improve the return loss, the antenna gain may be reduced. In addition, the collinear dipole antenna 40 has the best antenna gain and the worst return loss (maximum to be −4.48 dB). As a result, a number of the sections of the collinear dipole antenna is positively correlated with the antenna gain of the collinear dipole antenna on the horizontal section, i.e. the antenna gain on the horizontal section increases as the number of the sections of the collinear dipole antenna increases, though the return loss could be reduced.

Note that for an ideal half-wavelength dipole antenna composed of two radiators that their lengths are a quarter-wavelength, both the two radiators have the pure PCP, the same phase to be synchronized and the same energy distribution, thereby an ideal omni-directional pattern and an ideal bandwidth may be reached. Accordingly, the present invention further studies the current distribution on the radiators in search of differences between the collinear dipole antennas 20, 40 and 50 and the ideal half-wavelength dipole antenna, so as to improve the antenna gain and return loss (or bandwidth).

Figure 10:
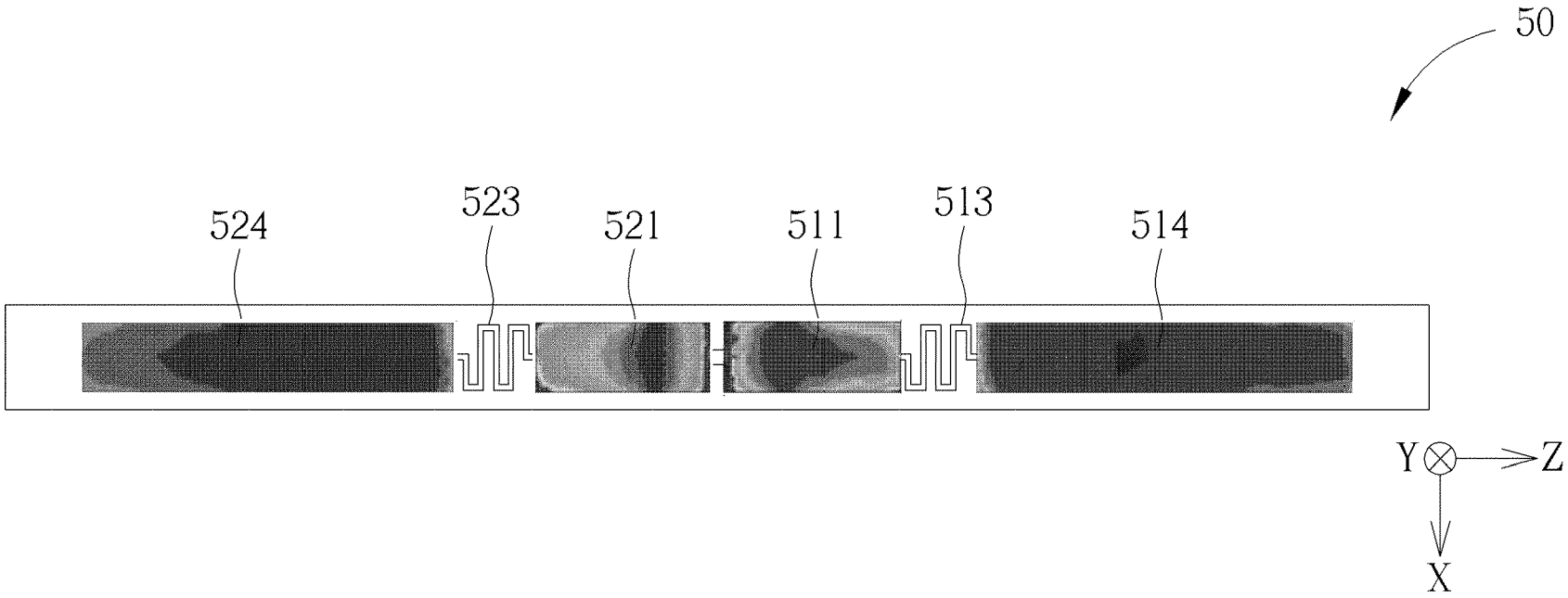
FIG. 10 shows a current distribution of the collinear dipole antenna shown in FIG. 5.

FIG. 10 shows a current distribution of the collinear dipole antenna 50, wherein the current intensity of the collinear dipole antenna 50 from the minimum to the maximum is denoted from black to white. As shown in FIG. 10, the current with higher intensity shows at the arms 511 and 521, while the current with lower intensity shows at the branches 514 and 524. Thus, the collinear dipole antenna 50 looks like to a one-section dipole antenna composed of two radiators having a quarter-wavelength. In other words, as long as the current distribution is not uniformly distributed on the radiators, the antenna gain is limited even if the number of sections of the antenna is increased.

Noticeably, when the current phase of the collinear dipole antenna 50 switches its polarity, a wider width of the arm 511 changes dramatically to a narrower width of the branch 513. Thus, characteristic impedance of the collinear dipole antenna 50 changes dramatically from the arm 511 to the branch 513, which causes impedance mismatch between the arm 511 to the branch 513. As a result, the current with higher intensity stays at the arm 511, while the current with lower intensity shows at the branch 514. Similarly, the current with higher intensity stays at the arm 521, while the current with lower intensity shows at the branch 524.

Figure 11:
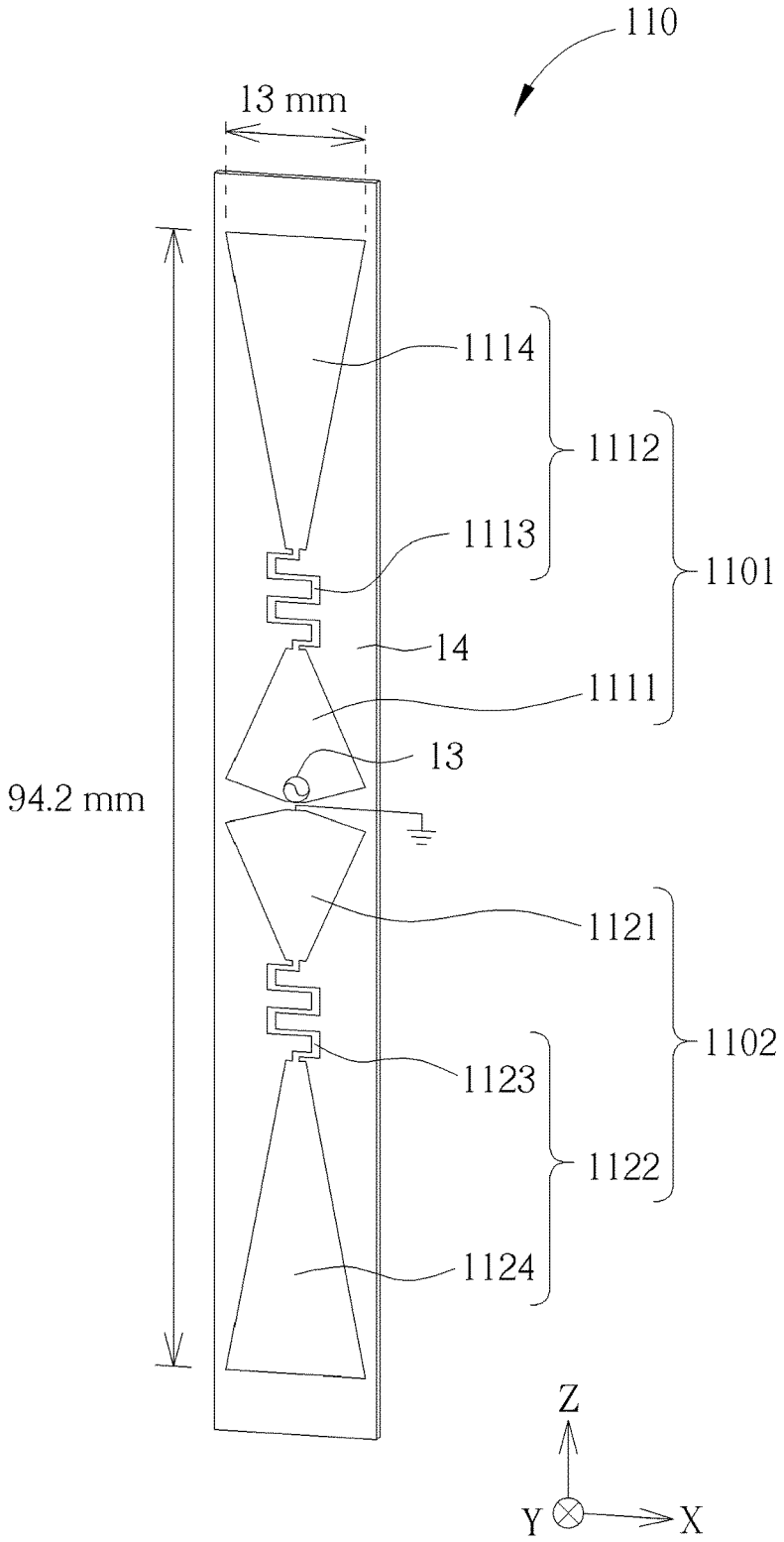
FIG. 11 is a schematic diagram of a collinear dipole antenna according to an embodiment of the present invention.

In order to make a uniform current distribution on the collinear dipole antenna, FIG. 11 shows a schematic diagram of a collinear dipole antenna 110 according to an embodiment of the present invention. The collinear dipole antenna 110 includes radiators 1101 and 1102, a feed terminal 13, and a substrate 14. The radiators 1101 and 1102 are formed on the substrate 14. The radiator 1101 includes an arm 1111 and at least one arm 1112, where the arms 1111 and 1112 are cascaded each other. The arm 1111 is electrically connected to the feed terminal 13, and extends from the feed terminal 13 along the Z direction, so as to feed a radio signal to the radiator 1101 via the feed terminal 13. The arm 1112 is electrically connected to the arm 1111, and extends from the arm 1111 along the Z direction, wherein the arm 1112 includes branches 1113 and 1114. The branch 1113 is electrically connected between the arm 1111 and the branch 1114. One end of the branch 1114 is electrically connected to the branch 1113, and the other end of the branch 1114 is open. The radiator 1102 includes an arm 1121 and at least one arm 1122, where the arms 1121 and 1122 are cascaded to each other. The arm 1121 is electrically connected to a ground, and extends from the ground along a −Z direction, such that a return current of the radio signal is guided from the arm 1121 to the ground. The arm 1122 is electrically connected to the arm 1121, and extends from the arm 1121 along the −Z direction, wherein the arm 1122 includes branches 1123 and 1124. The branch 1123 is electrically connected between the arm 1121 and branch 1124. One end of the branch 1124 is electrically connected to the branch 1123 and the other end of the branch 1124 is open.

The collinear dipole antenna 110 is featured that the branch 1113 with the NCP has a meandering shape, while the arm 1111 and the branch 1114 with the PCP have a bishop-hat shape or a kite-shape.

In such a structure, when a current phase of the collinear dipole antenna 110 switches its polarity, widths of the arm 1111 and the branch 1114 gradually change to match a width of the branch 1113, so that characteristic impedances of the arm 1111 and the branch 1114 match with a characteristic impedance of the branch 1113. Similarly, widths of the arm 1121 and the branch 1124 gradually change to match the width of the branch 1123. Therefore, the current intensities may be uniformly distributed on the arms 1111 and 1121 and the branches 1113, 1123, 1114 and 1124 of the collinear dipole antenna 110.

Take the radiator 1101 for example, the width of the arm 1111 gradually increases from the feed terminal to a maximum width and gradually decreases after the maximum width is reached, such that the width of the arm 1111 matches with the width of the branch 1113. Furthermore, the width of the branch 1114 gradually increases from where the branch 1114 and the branch 1113 are connected until the maximum width is reached.

Figure 12:
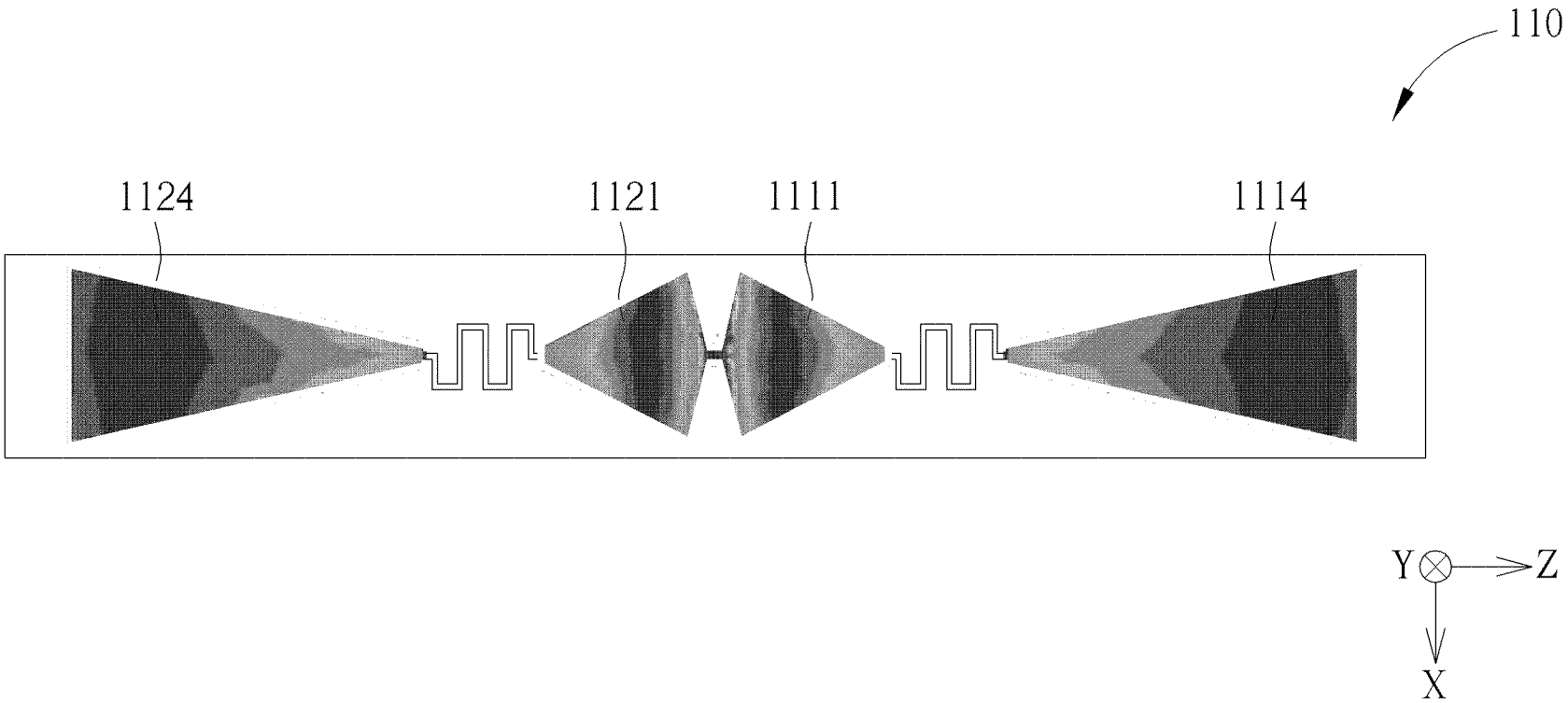
FIG. 12 shows a current distribution of the collinear dipole antenna shown in FIG. 11.

FIG. 12 shows a current distribution of the collinear dipole antenna 110, wherein the current intensity of the collinear dipole antenna 110 from the minimum to the maximum is denoted from black to white. As shown in FIG. 12, different from FIG. 10, the current intensities on the arm 1111, branch 1114, arm 1121 and branch 1124 are distributed uniformly, so the collinear dipole antenna 110 may operate like the ideal collinear dipole antenna to have characteristics such as synchronized phase and uniform energy distribution.

In short, in the collinear dipole antenna of the present invention, the arms and branches with the PCP have a bishop-hat shape. Thus, as the current phase of the collinear dipole antenna switches its polarity, the widths (or characteristic impedances) of the arms and branches with the PCP gradually change to match with the widths (or characteristic impedances) of the branches with the NCP. As such, the current intensities may be uniformly distributed on the collinear dipole antenna. In addition, the branches with the NCP have a meandering shape, so the current intensities of the branches with the NCP may be effectively reduced, which reduces the reduction to current intensities of the arms and branches with the PCP along the Z direction. Therefore, the antenna gain of the collinear dipole antenna may be increased by reducing the current intensities of the branches with the NCP.

Any collinear dipole antenna that meets the collinear dipole antenna of the aforementioned embodiment should be within the scope of the present invention. The collinear dipole antenna can be made modifications and alterations accordingly, which is not limited to the embodiments of the present invention. For instance, the arms and branches with the PCP may have a teardrop shape, so that their shape changes more smoothly. The number of the sections of the collinear dipole antenna may not be limited, wherein a number of the sections may be positively correlated with the antenna gain of the collinear dipole antenna on the horizontal section. In other words, as the number of the sections (i.e., a number of the arms and branches with the PCP in a single radiator) increases, the antenna gain of the collinear dipole antenna on the horizontal section increases.

Figure 13:
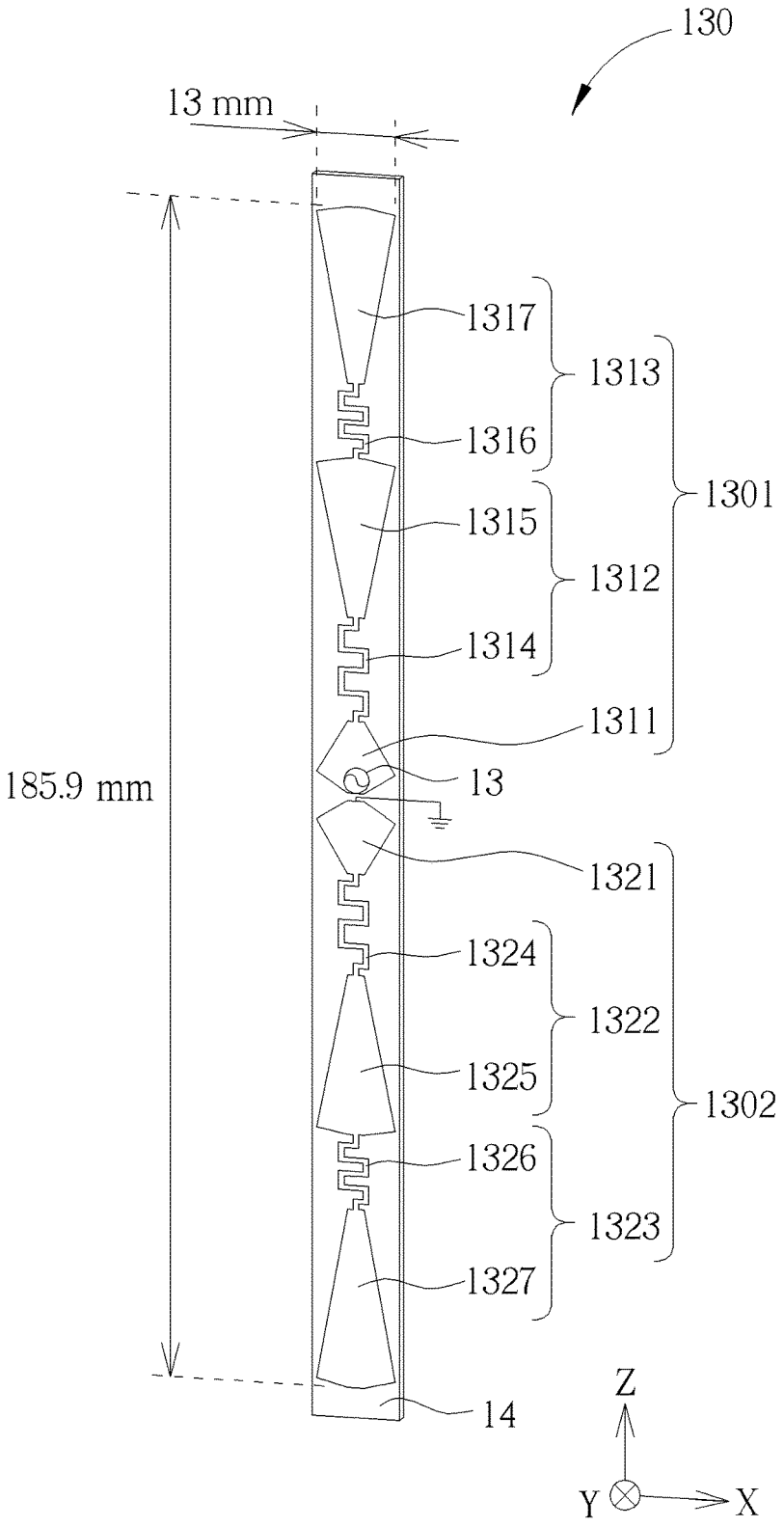
FIG. 13 is a schematic diagram of a collinear dipole antenna according to another embodiment of the present invention.

FIG. 13 is a schematic diagram of a collinear dipole antenna 130 according to an embodiment of the present invention. Different from the collinear dipole antenna 110, the collinear dipole antenna 130 is formed by extending the collinear dipole antenna 110 by a wavelength longer, so as to form a three-section collinear dipole antenna. The collinear dipole antenna 130 includes radiators 1301 and 1302. The radiator 1301 includes arms 1311, 1312 and 1313. The arm 1312 includes branches 1314 and 1315, and the arm 1313 includes branches 1316 and 1317. The radiator 1302 includes arms 1321, 1322 and 1323. The arm 1322 includes branches 1324 and 1325, and the arm 1323 includes branches 1326 and 1327. In one embodiment, for the 5 GHz frequency band, a width and a length of the collinear dipole antenna 130 are respectively 13 millimeters and 185.9 millimeters.

Figure 14:
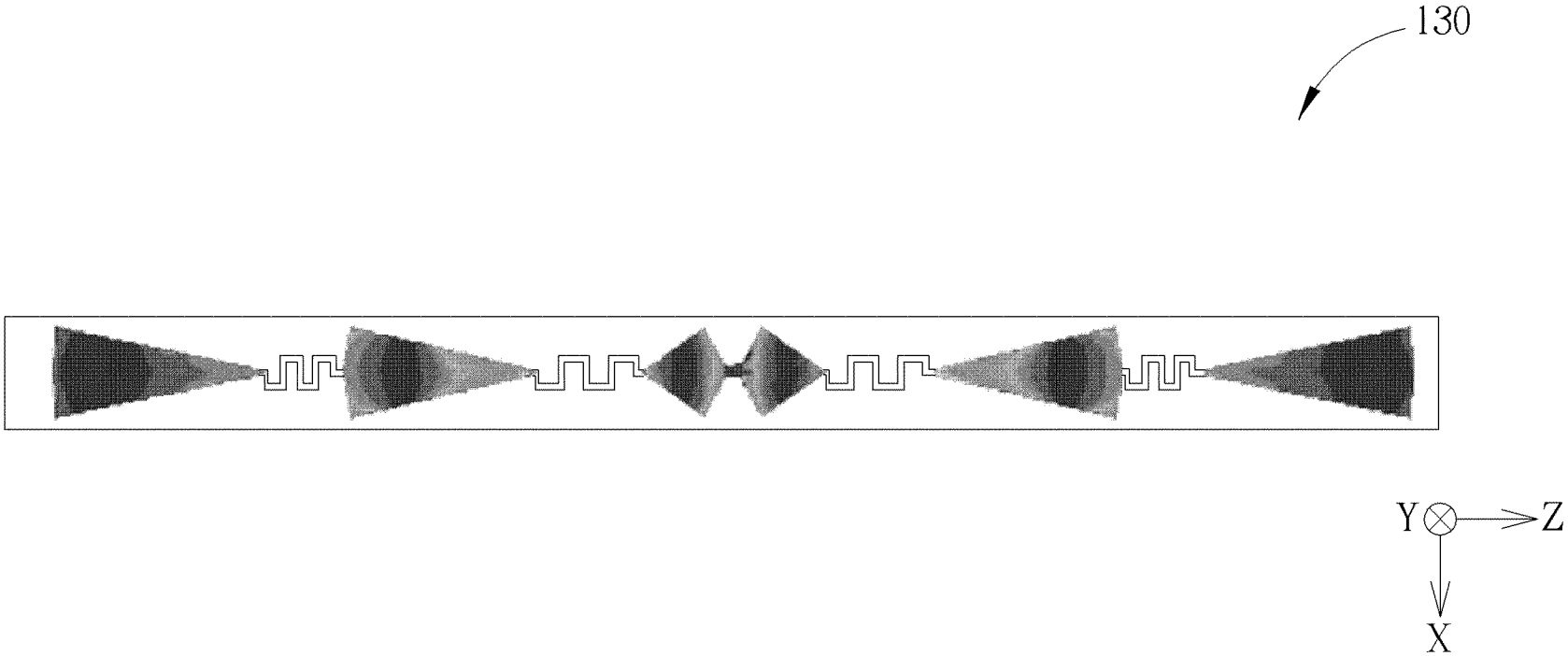
FIG. 14 shows a current distribution of the collinear dipole antenna shown in FIG. 13.

FIG. 14 shows a current distribution of the collinear dipole antenna 130, wherein the current intensity of the collinear dipole antenna 130 from the minimum to the maximum is denoted from black to white. As shown in FIG. 14, different from FIG. 10, the current intensities on the arm 1311, branch 1315, branch 1317, arm 1321, branch 1325 and branch 1327 are distributed uniformly, so the collinear dipole antenna 130 may operate like the ideal collinear dipole antenna to have characteristics such as synchronized phase and uniform energy distribution to improve the return loss and the antenna gain.

Figure 15:
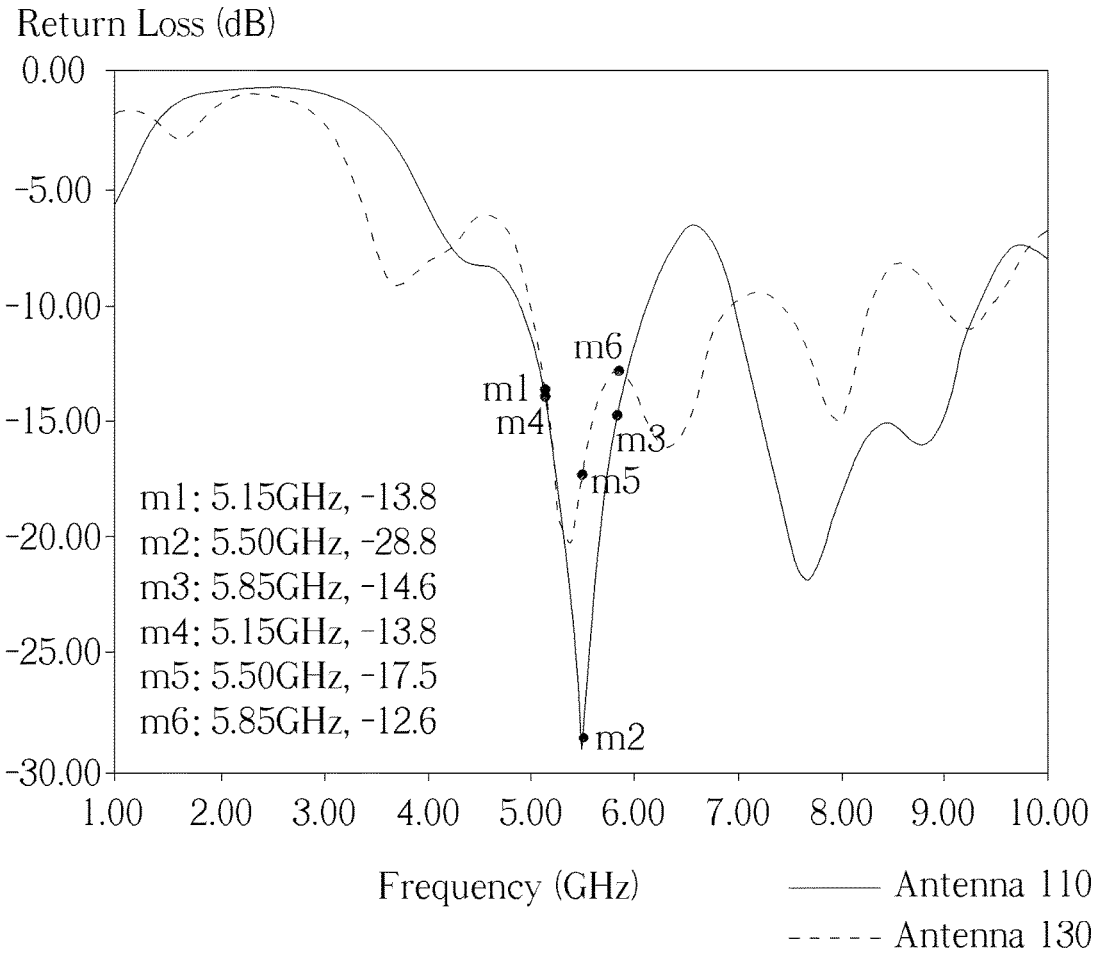
FIG. 15 shows simulations of return losses of the collinear dipole antennas shown in FIG. 11 and FIG. 13.

FIG. 15 shows simulations of return losses of the collinear dipole antennas 110 and 130, wherein the return losses of the collinear dipole antennas 110 and 130 are respectively denoted with a thin solid line and a dotted line. In addition, the antenna gains on the horizontal section of the collinear dipole antennas 110 and 130 are summarized in Table 2.

TABLE 2

(Unit: dBi)

| Frequency (GHz) | Antenna 110 | Antenna 130 |
|---|---|---|
| 5.15 | 4.15-4.60 | 6.17-6.57 |
| 5.50 | 4.60-5.09 | 6.66-7.12 |
| 5.85 | 4.71-5.24 | 6.28-6.78 |

According to FIG. 15 and Table 2, the return loss of the collinear dipole antenna 110 is better than the return loss of the collinear dipole antenna 130, while the antenna gain of the collinear dipole antenna 130 is better than the antenna gain of the collinear dipole antenna 110 (i.e., the antenna gain of the collinear dipole antenna is higher if it has more sections). Both the return loss and the antenna gain of the collinear dipole antennas 110 and 130 are better than that of the collinear dipole antennas 20, 40 and 50. As a result, the structure that the arms and the branches with the PCP have the bishop-hat shape, and the branches with the NCP have meandering shape may simultaneously improve the return loss and the antenna gain.

Figure 16:
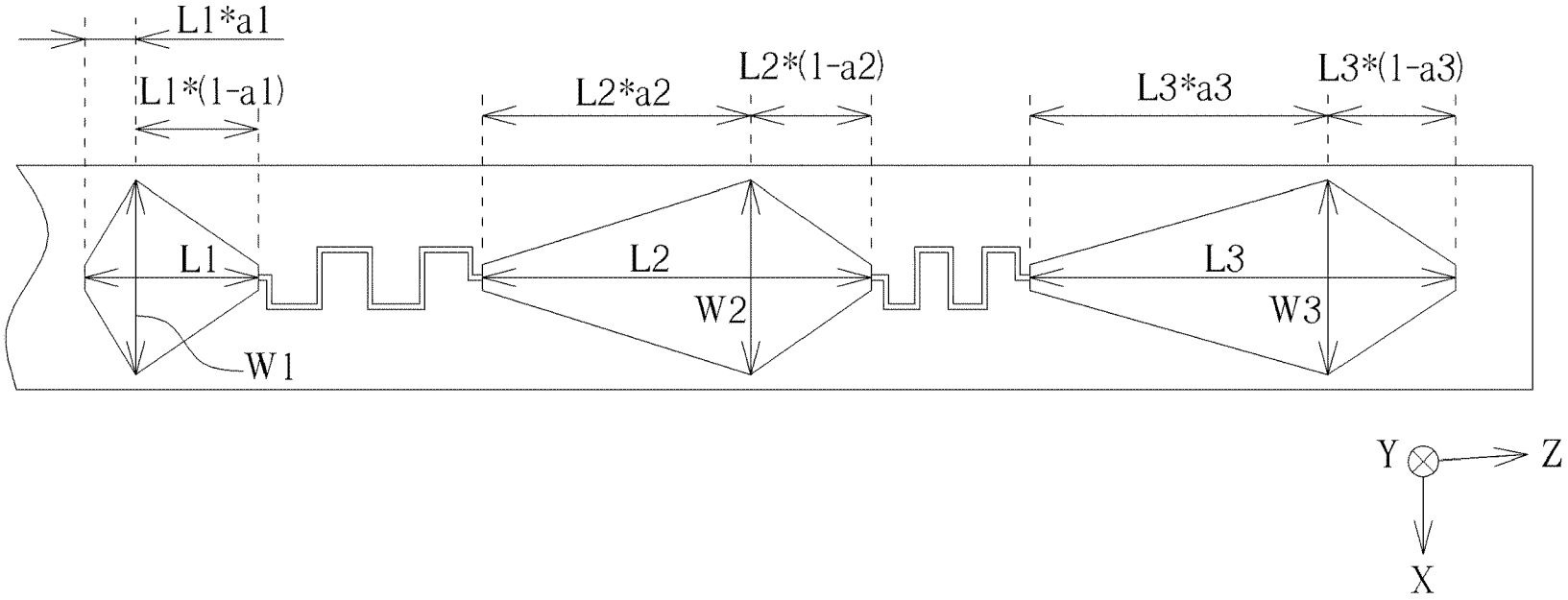
FIG. 16 shows a reference size of a collinear dipole antenna according to an embodiment of the present invention.

Note that the shapes and sizes of the collinear dipole antennas 110 and 130 are not limited and may be adjusted according to practical requirements. Specifically, FIG. 16 shows a reference size of a collinear dipole antenna according to an embodiment of the present invention. The collinear dipole antenna in FIG. 16 represents any of the collinear dipole antennas in the above embodiments. The arms and branches with the PCP respectively have maximum widths (i.e., a short diagonal of the bishop-hat shape) W1, W2 and W3, and lengths (i.e., a long diagonal of the bishop-hat shape) L1, L2 and L3. The maximum width W is perpendicular to the length L1, the maximum width W2 is perpendicular to the length L2, and the maximum width W3 is perpendicular to the length L3. The maximum widths W1, W2 and W3 are substantially negatively correlated with a return loss of an operating frequency of the collinear dipole antenna. In other words, the return loss (also known as a parameter S11) is smaller if the maximum widths W1, W2 and W3 are wider. The maximum widths W1, W2 and W3 are substantially positively correlated with an antenna gain of the operating frequency of the collinear dipole antenna.

The length L1 is substantially equal to a quarter-wavelength of an operating frequency of the collinear dipole antenna. The length L2 and the length L3 are substantially equal to a half-wavelength of the operating frequency, but the length L2 may not be equal to the length L3 in another embodiment. A cross point of the length L1 and the maximum width W1 divides the length L1 into two segments. A cross point of the length L2 and the maximum width W2 divides the length L2 into two segments. A cross point of the length L3 and the maximum width W3 divides the length L3 into two segments.

The diagonal L1 is divided into a first segment L1*a1 and a second segment L1*(1−a1). The diagonal L2 is divided into a first segment L2*a2 and a second segment L2*(1−a2). The diagonal L3 is divided into a first segment L3*a3 and a second segment L3*(1−a3), where a1, a2 and a3 are ratios between 0 and 1.

The shapes and sizes of the collinear dipole antennas 110 and 130 are not limited, which can be adjusted by adjusting the maximum widths W1, W2 and W3 , the lengths L1, L2 and L3 and the ratios a1, a2 and a3. In practice, the size of each section (including the size and shape of the bishop-hat shape, and the length and width of the meandering shape) may be different and may be individually adjusted according to practical requirements. The reference sizes of the maximum widths W1, W2, W3, the lengths L1, L2, L3, and the ratios a1, a2 and a3 are summarized in Table 3.

TABLE 3

(Unit: millimeters)

| | W1 | W2 | W3 | L1 | L2 | L3 | a1 | a2 | a3 |
|---|---|---|---|---|---|---|---|---|---|
| Antenna 110 | 13 | 13 | N/A | 12.4 | 25.9 | N/A | 0.1 | 1.0 | N/A |
| Antenna 130 | 13 | 13 | 13 | 11.6 | 26.0 | 28.7 | 0.3 | 0.96 | 0.99 |

Note that the maximum width shall be located close to the open end (i.e. the ratio a2 of the collinear dipole antenna 110 is 1.0 and the ratio a3 of the collinear dipole antenna 130 is approximated to 1.0), this is because the characteristic impedance at the open end is infinitely large, and the maximum width shall be located close to the open end to obtain a greater current intensity at the open end. The ratio a2 of the branch 1114 in FIG. 11 is 1.0, while the ratio a3 of the branch 1317 in FIG. 13 is 0.99. In one embodiment, the ratios a1 of the arm 1111 in FIG. 11 and the arm 1311 in FIG. 13 are less than 0.5.

In addition, the collinear dipole antenna of the present invention may be applied to various communication devices equipped with a radio signal processing unit that transmits and receives radio signals, such as wireless access points, laptops, tablet personal computers, mobile phones, or electronic books.

To sum up, in the collinear dipole antenna of the present invention, the arms and branches with the PCP have a bishop-hat shape. Thus, as the current phase of the collinear dipole antenna switches its polarity, the widths (or characteristic impedances) of the arms and branches with the PCP change gradually to match the widths (or characteristic impedances) of the branches with the NCP. As such, the current intensities may be uniformly distributed on the collinear dipole antenna. In addition, the branches with the NCP have a meandering shape, so the current intensities of the branches with the NCP may be effectively reduced, which reduces the reduction to current intensities of the arms and branches with the PCP. Therefore, the antenna gain of the collinear dipole antenna may be increased by reducing the current intensities of the branches with the NCP.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A collinear dipole antenna, comprising:

a substrate;

a feed terminal;

a first radiator, formed on the substrate and electrically connected to the feed terminal, wherein the first radiator comprises:

a first arm with a positive current phase, electrically connected to the feed terminal and extending from the feed terminal along a first direction; and at least one second arm, electrically connected to the first arm and extending from the first arm along the first direction, wherein the at least one second arm comprises a first branch with a negative current phase and electrically connected to the first arm, and a second branch with the positive current phase and electrically connected to the first branch; and a second radiator, formed on the substrate and electrically connected to a ground, wherein the second radiator comprises:

a third arm with the positive current phase, electrically connected to the ground and extending from the ground along an opposite of the first direction; and at least one fourth arm, electrically connected to the third arm and extending from the third arm along the opposite of the first direction, wherein the at least one fourth arm comprises a third branch with the negative current phase and electrically connected to the third arm, and a fourth branch with the positive current phase and electrically connected to the third branch;

wherein the first and third branches have a meandering shape, widths of the first arm and the third arm gradually increase from where the first arm and the third arm are connected to the feed terminal and the ground until a maximum width is reached, and the widths of the first arm and the third arm gradually decrease after the maximum width is reached;

wherein widths of the second and fourth branches gradually increase from where the second and fourth branches are connected to the first branch and the third branch until the maximum width is reached, and the widths of the second and fourth branches gradually decrease after the maximum width is reached.

2. The collinear dipole antenna of claim 1, wherein a number of the at least one second arm and the at least one fourth arm is positively correlated with an antenna gain on a horizontal section of the collinear dipole antenna.

3. The collinear dipole antenna of claim 1, wherein the maximum width of the first arm, the third arm, the second branch and the fourth branch is negatively correlated with a return loss of an operating frequency of the collinear dipole antenna.

4. The collinear dipole antenna of claim 1, wherein the maximum width is positively correlated with an antenna gain of an operating frequency of the collinear dipole antenna.

5. The collinear dipole antenna of claim 1, wherein a first length of the first arm and the third arm is substantially equal to a quarter-wavelength of an operating frequency of the collinear dipole antenna, a second length of the second branch and the fourth branch and the second length of the first branch and the third branch are substantially equal to a half-wavelength of the operating frequency of the collinear dipole antenna, and a direction of the first length and the second length is parallel to the first direction.

6. The collinear dipole antenna of claim 5, wherein a cross point of the first length of the first arm and the third arm and the maximum width divides the first length into a first segment and a second segment, which are respectively denoted as:

$$S1=L1*a1;$$

$$S2=L1*(1-a1);$$

wherein S1 and S2 are the first segment and the second segment, L1 is the first length, a1 is a ratio of the first length and ranges from 0 and 1, and the first segment is a distance from where the first arm and the third arm are connected to the feed terminal or the ground to the cross point.

7. The collinear dipole antenna of claim 6, wherein the ratio of the first length is less than 0.5.

8. The collinear dipole antenna of claim 5, wherein a cross point of the second length of the second branch and the fourth branch and the maximum width divides the second length into a first segment and a second segment, which are respectively denoted as:

$$S1=L2*a2;$$

$$S2=L2*(1-a2);$$

wherein S1 and S2 are the first segment and the second segment, L2 is the second length, a2 is a ratio of the second length and ranges from 0 and 1, and the first segment is a distance from where the second branch is connected to the first branch to the cross point, or from where the fourth branch is connected to the third branch to the cross point.

9. The collinear dipole antenna of claim 8, wherein the ratio of the second length is approximated to or equal to 1.

10. The collinear dipole antenna of claim 1, wherein the first arm, the third arm, the second branch and the fourth branch have a bishop-hat shape or a teardrop shape.

11. A communication device, comprising:

a radio signal processing unit for processing a radio signal; and a collinear dipole antenna, comprising:

a substrate;

a feed terminal, for feeding in the radio signal;

a first radiator, formed on the substrate and electrically connected to the feed terminal, wherein the first radiator comprises:

a first arm with a positive current phase, electrically connected to the feed terminal and extending from the feed terminal along a first direction; and at least one second arm, electrically connected to the first arm and extending from the first arm along the first direction, wherein the at least one second arm comprises a first branch with a negative current phase and electrically connected to the first arm, and a second branch with the positive current phase and electrically connected to the first branch; and a second radiator, formed on the substrate and electrically connected to a ground, wherein the second radiator comprises:

a third arm with the positive current phase, electrically connected to the ground and extending from the ground along an opposite of the first direction; and at least one fourth arm, electrically connected to the third arm and extending from the third arm along the opposite of the first direction, wherein the at least one fourth arm comprises a third branch with the negative current phase and electrically connected to the third arm, and a fourth branch with the positive current phase and electrically connected to the third branch;

wherein the first and third branches have a meandering shape, widths of the first arm and the third arm gradually increase from where the first arm and the third arm are connected to the feed terminal and the ground until a maximum width is reached, and the widths of the first arm and the third arm gradually decrease after the maximum width is reached;

wherein widths of the second and fourth branches gradually increase from where the second and fourth branches are connected to the first branch and the third branch until the maximum width is reached, and the widths of the second and fourth branches gradually decrease after the maximum width is reached.

12. The communication device of claim 11, wherein a number of the at least one second arm and the at least one fourth arm is positively correlated with an antenna gain on a horizontal section of the collinear dipole antenna.

13. The communication device of claim 11, wherein the maximum width of the first arm, the third arm, the second branch and the fourth branch is negatively correlated with a return loss of an operating frequency of the collinear dipole antenna.

14. The communication device of claim 11, wherein the maximum width is positively correlated with an antenna gain of an operating frequency of the collinear dipole antenna.

15. The communication device of claim 11, wherein a first length of the first arm and the third arm is substantially equal to a quarter-wavelength of an operating frequency of the collinear dipole antenna, a second length of the second branch and the fourth branch and the second length of the first branch and the third branch are substantially equal to a half-wavelength of the operating frequency of the collinear dipole antenna, and a direction of the first length and the second length is parallel to the first direction.

16. The communication device of claim 15, wherein a cross point of the first length of the first arm and the third arm and the maximum width divides the first length into a first segment and a second segment, which are respectively denoted as:

$$S1=L1*a1;$$

$$S2=L1*(1-a1);$$

wherein S1 and S2 are the first segment and the second segment, L1 is the first length, a1 is a ratio the first length and ranges from 0 and 1, and the first segment is a distance from where the first arm and the third arm are connected to the feed terminal or the ground to the cross point.

17. The communication device of claim 16, wherein the ratio of the first length is less than 0.5.

18. The communication device of claim 15, wherein a cross point of the second length of the second branch and the fourth branch and the maximum width divides the second length into a first segment and a second segment, which are respectively denoted as:

$$S1=L2*a2;$$

$$S2=L2*(1-a2);$$

wherein S1 and S2 are the first segment and the second segment, L2 is the second length, a2 is a ratio of the second length and ranges from 0 and 1, and the first segment is a distance from where the second branch is connected to the first branch to the cross point, or from where the fourth branch is connected to the third branch to the cross point.

19. The communication device of claim 18, wherein the ratio of the second length is approximated to or equal to 1.

20. The communication device of claim 11, wherein the first arm, the third arm, the second branch and the fourth branch have a bishop-hat shape or a teardrop shape.

* * * * *